United States Patent [19]

Saliaris

[11] Patent Number: 4,809,437

[45] Date of Patent: Mar. 7, 1989

[54] MANUALLY MANIPULATED CUTTING DEVICE

[76] Inventor: George P. Saliaris, 1847 Arlington Ave., Columbus, Ohio 43212

[21] Appl. No.: 91,120

[22] Filed: Aug. 31, 1987

[51] Int. Cl.[4] ..... B26B 3/00

[52] U.S. Cl. ..... 30/319; 30/307

[58] Field of Search ..... 30/307, 319, 164.95, 30/114, 365, 418, 422, 424, 425, 426, 427, 440, 441

[56] References Cited

U.S. PATENT DOCUMENTS 1,363,104 12/1920 Foss ..... 30/319 X 2,718,853 9/1955 Zichichi ..... 30/319 X

*Primary Examiner*—Douglas D. Watts

*Attorney, Agent, or Firm*—Francis T. Kremblas, Jr.

[57] ABSTRACT

A manual cutting device for severing generally planar food stuffs, such as pizza, which is characterized by an elongate handle provided with a removably mounted, circular cutting blade rotatably mounted to the handle. A removably mounted pivot pin is provided which is releasably locked through aligned openings in the handle and the circular cutting blade to permit easy assembly and dis-assembly of the handle and cutting blade for cleaning purposes.

5 Claims, 3 Drawing Sheets

MANUALLY MANIPULATEC CUTTING DEVICE

BACKGROUND

Cutting utensils of various configurations are numerous in the prior art. The present invention relates to a manual cutting device of the type having a disc-like circular blade rotatably mounted to a handle which is useful for cutting pizza or other relatively thin planar food stuffs. While persons still use the conventional long, heavy bladed knife for cutting food articles such as pizza, there are a substantial number of persons who prefer the circular, rotatable type blade for such applications. This is particularly true for those whoe prefer to cut a pizza into triangular or pie-shaped wedges.

However, the major drawback to using such circular bladed cutters, particularly in commercial applications, is the difficulty in cleaning the device after use.

Since such rotating circular blades possess a construction which inherently involves small crevices, it is extremely difficult to remove any food particles which frequently become embedded therein. Without adequate removal of such particles, bacteria build-up resulting in an unsanitary condition occurs rapidly. Given the properly strict food handling laws required in commercial establishments and the natural tendency of all persons to avoid use of a potentially unwholesome utensil, the use of such a convenient rotary cutting tool for such purposes has been significantly inhibited by this problem.

SUMMARY OF PRESENT INVENTION

The present invention is directed to a novel manually operated cutting device which includes a circular blade rotatably mounted on a convenient handle. However, the cutting blade is removably mounted to the handle to facilitate fast and simple assembly and dis-assembly to permit easy cleaning of all the component parts including the handle, blade and shaft.

The handle portion includes a pair of longitudinal side portions, spaced from one another to form a slot to receive a portion of the circular blade therein with a major portion of the blade extending outwardly therefrom. The blade is removably mounted by means of a keyed shaft or pin which is inserted into aligned and keyed holes provided in the side members and the blade. The pin is removably mounted and releasably fixed against rotation within the keyed holes such that the assembly is secure. However, upon release and removal of the pin, dis-assembly is easily accomplished.

OBJECTS

It is therefore a primary object of the present invention to provide a circular bladed cutting device for manual slicing of pizza and the like which can be easily and quickly dis-assembled for cleaning and then reassembled for use to advance sanitary conditions.

It is another object of the present invention to provide a circular, rotatable blade cutting device which may be manufactured at relatively low cost in volume using plastic molded parts.

It is a further object of the present invetion to provide a cutting blade device of the type described which includes a keyed shaft and bore arrangement to provide a simple, yet secure means to rotatably mount the circular blade to the handle portion in a removable manner.

IN THE DRAWINGS

DETAILED DESCRIPTION

Figure 1:
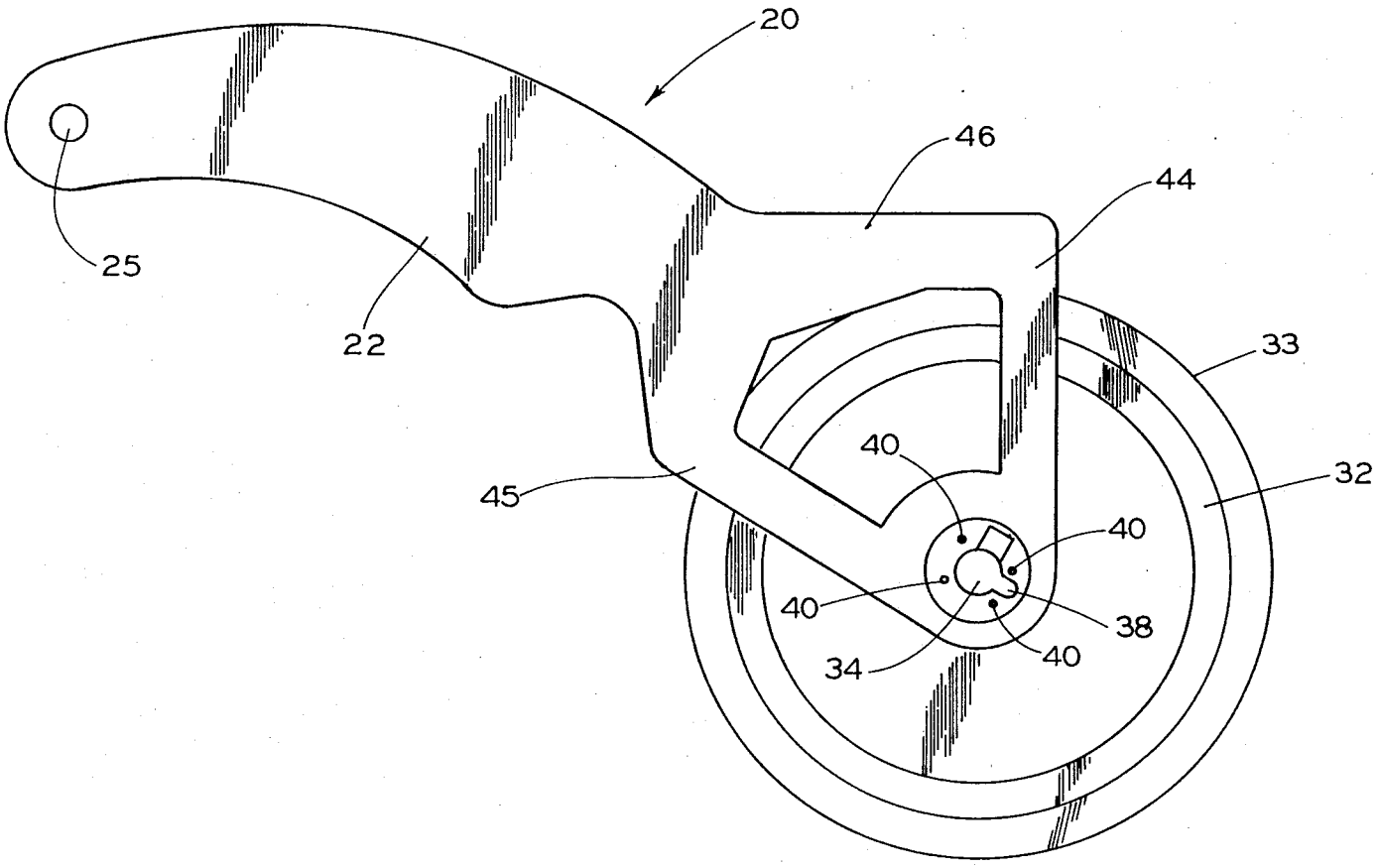
FIG. 1 is a left side elevational view of a cutting device for pizza and similar food products constructed in accordance with the present invention.
Figure 2:
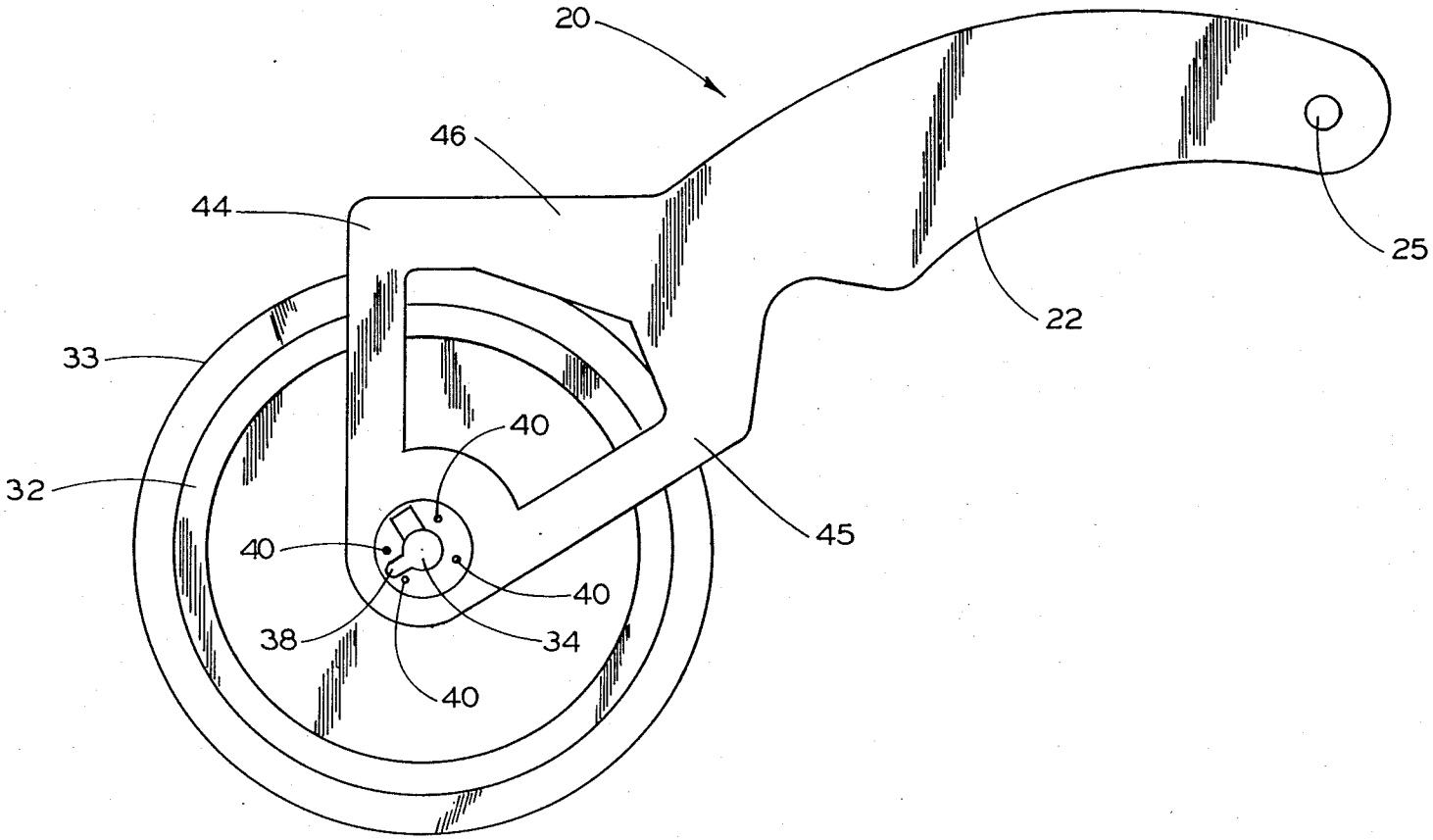
FIG. 2 is a right side elevational view of the cutting device shown in FIG. 1.
Figure 3:
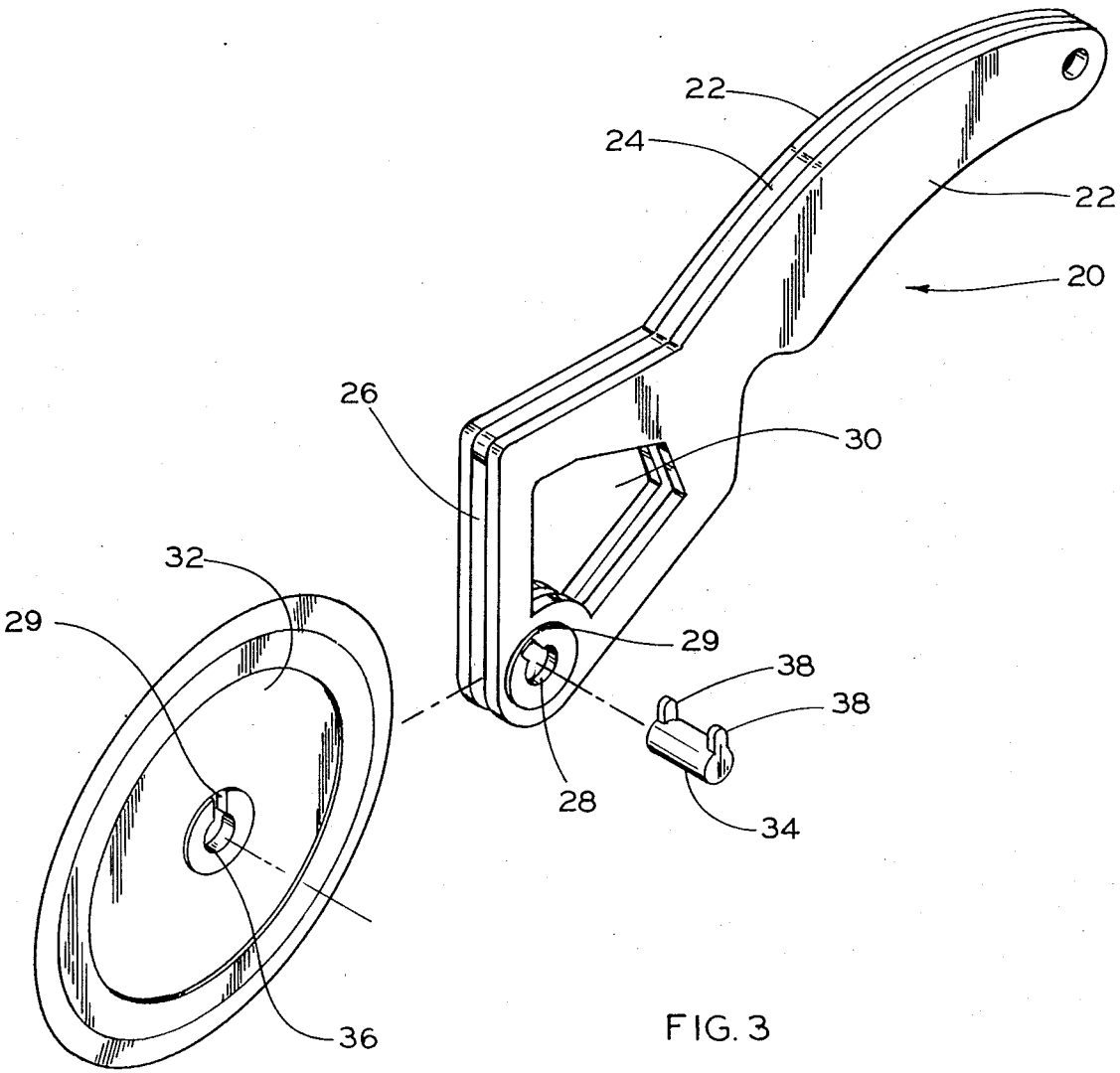
FIG. 3 is a perspective view of the cutting device shown in the preceding Figures illustrating the components in exploded relationship.

A cutting device for food products and the like, constructed in accordance with the present invention, is shown in FIGS. 1, 2 and 3 and includes a handle portion, indicated generally at 20, which facilitates manual manipulation of the device.

Handle 20 includes two contoured outer side portions 22 and an inner portion 24. The outermost ends of side portions 22 form the primary means for manual grasping of the device. Inner portions 24 functions as a spacer to separate the inner ends of side portions 22 apart from one another to form an opening or slot 26. Portion 24 is fixed to members 22 by an adhesive or other suitable means.

Each of the inner ends of side member 22 also include aligned key-ways 28. An open space 30 intermediate opposing ends of side members 22 is provided to reduce material and to aid in cleaning the components parts as will be described later herein. A hole 25 is provided near the outer end of side members 22 to permit the device to be hung on a peg or the like when not in use.

A disc-shaped, circular cutting blade 32 is rotatably mounted to handle 22 via a keyed pin or shaft member 34. Blade 32 includes a key-way 36 of complimentary dimensions to key-ways 28 such that upon insertion of blade 32 into slot 26 and alignment of key-ways 28 and 36, keyed shaft 34 may be inserted through the respective key-ways. Blade 32 includes a sharp outer edge 33 forming a cutting surface.

Keyed shaft 34 is provided with a pair of ears 38 at each end thereof and is of sufficient length that the ears 38 extend laterally outwardly of each side member 22. Shaft 34 is releasably fixed against normal rotation via a plurality of spaced, relatively small protrusions 40 provided on the outward surface of at least one of side members 22. Upon alignment of shaft 34 such that ears 38 pass through the respective openings 29 of key-ways 28 and 36, shaft 34 may be manually rotated with sufficient force to cause ears 38 to pass over protrusions 40 to a position unaligned with opening 29.

With shaft 34 in this position, the assembled components are releasably locked in operable relationship with blade 32 rotatably mounted to handle 20 for normal use in a similar manner to conventional, permanently mounted cutting devices of this type.

After use of the cutting device, it may be quickly dis-assembled to facilitate cleaning of the separate component parts to significantly enhance removal of food particles from all portions of the device. To dis-assemble the blade 32 from handle 20, one merely forceably rotates ears 38 over protrusions 40 until the ears 38 are aligned with opening 29 of the respective key-ways 28 and 36. This may be more easily accomplished because of the inherent resilient nature of the plastic material forming the ears 38 and protrusions 40 and the relatively small size of protrusions 40. Then shaft 34 may be urged through the respective key-ways and completely removed therefrom.

With blade 32 removed, it should be noted that all interior surfaces of slot 26 are accessible for cleaning and inspection to assure that all food debris is removed. It is these interior surfaces and relatively small spaces which are difficult to thoroughly clean and therefore harbor traces of food to form ideal conditions for bacteria growth. Similarly, all surfaces of blade 32 and shaft 34 may be more easily and thoroughly cleaned when completely removed from the handle portion. After cleaning, blade 32 may be quickly assembled in the manner described herein and readied for further use.

The open space 30 reduces the area of potential contact between food particles adhering to blade 32 and the inner surfaces of side members 22 which form slot 26 and provides improved access to the inner surfaces during the cleaning process.

As an additional feature of the present invention, the inner end of each side member 22 include spaced arm portions 44 and 45 which are integrally formed with a connecting web portion 46 which surrounds the open space 30. In cooperation with the outer end of handle 20, a user may conveniently place either their thumb of the grasping hand or the heel of their free hand over the upper portion of web 46 to press downwardly with greater force as may be necessasry to more easily cut through the food product.

In addition, the angular orientation between the upper portion of web 46 and arm 44 is near ninety degrees. In cooperation with the remaining portion of handle 20, this tends to dispose leg 44 approximately perpendicular to the horizontal to more directly apply the force exerted by the user upon the upper portion of web 46 downwardly upon the food to be cut. Therefore less overall force is necessary to effectively cut the food product compared to prior conventional devices of this kind.

As applicable to pizza or the like, this is particularly useful when a product has a harder, crisper crust or is unusually thick and conveniently aids a user having lesser strength, such as a child, women or elderly persons.

It should be also noted that the construction of the present invention lends itself to manufacture employing molded plastic parts which are easily assembled to provide an inexpensive, but durable cutting device having the aforementioned advantages.

What is claimed is:

1. A manually operated food cutting device comprising, in combination, an elongated handle having a first end configured to form a gripping means and a second end disposed in longitudinally spaced relationship to said first end, said second end provided with a pair of laterally spaced, longitudinally extending side members forming a longitudinally extending open-ended slot; a generally disc-shaped cutting means partially extending into said slot and and mounted to a shaft extending through said side members for rotation about a lateral axis, said shaft being releasably keyed to said side members between a fixed and removable position by rotation of said shaft less than 180 degrees.

2. The device defined in claim 1 wherein said each of side members forming said slot include a pair of converging arm members joining with one another at one end and connected at their opposing end by a web portion integrally formed with said handle to define a generally triangular opening exposing a portion of said cutting means disposed within said slot; and wherein at least one of said arm members joins a portion of said web at approximately a right angle.

3. The device defined in claim 1 wherein each of the inner ends of said side members include laterally aligned keyed holes and said cutting means is provided with a centrally disposed complimentary keyed hole aligned with said keyed holes in said side members; and a keyed shaft extending through said aligned keyed holes to rotatably mount said cutting means in said slot; and means disposed on an outer surface of at least one of said side members, cooperable with an upraised ear on said shaft, to releasably fix said shaft within said keyed holes.

4. A manually operated food cutting device comprising, in combination, an elongated handle having a first end configured to form a gripping means a second end disposed in longitudinally spaced relationship to said first end, said second end provided with a pair of laterally spaced, longitudinally extending side members forming a longitudinally extending open-ended slot; each of said side members including a pair of converging arm members joining with one another at one end and connected at their opposing end by a web portion integrally formed with said handle to define a generally triangular opening, at least one of said arm members joining said web at approximately a right angle; a generally disc-shaped cutting means partially extending into said slot and mounted to said side members for rotation about a lateral axis with a portion of said cutting means exposed through said triangular opening.

5. A manually operated food cutting device comprising, in combination, an elongated handle having a first end configured to form a gripping means and a second end disposed in longitudinally spaced relationship to said first end, said second end provided with a pair of laterally spaced, longitudinally extending side members forming a longitudinally extending open-ended slot; a generally disc-shaped cutting means partially extending into said slot and releasably mounted to said side members for rotation about a lateral axis; each of the inner ends of said side members include laterally aligned keyed holes and said cutting means is provided with a centrally disposed complimentary keyed hole aligned with said keyed holes in said side members; and a keyed shaft extending through said aligned keyed holes to rotatably mount said cutting means in said slot; and means disposed on an outer surface of at least one of said side members, cooperable with an upraised ear on said shaft, to releasably fix said shaft within said keyed holes.

* * * * *